United States Patent [19]

Hotta

[11] Patent Number: 4,917,948

[45] Date of Patent: Apr. 17, 1990

[54] REVERSIBLE THERMOSENSITIVE RECORDING MATERIAL

[75] Inventor: Yoshihiko Hotta, Numazu, Japan

[73] Assignee: Ricoh Company, Ltd., Tokyo, Japan

[21] Appl. No.: 302,247

[22] Filed: Jan. 27, 1989

[30] Foreign Application Priority Data

Jan. 27, 1988 [JP] Japan ..... 63-014754

[51] Int. Cl.[4] ..... B41M 5/18

[52] U.S. Cl. ..... 428/335; 346/135.1; 428/195; 428/327; 428/336; 428/447; 428/474.4; 428/480; 428/521; 428/522; 428/913; 525/301.5; 525/376; 525/378; 525/386; 525/426; 525/437; 525/445

[58] Field of Search ..... 428/195, 484, 488.1, 428/913, 914, 411.1, 327, 335, 336, 447, 474.4, 480, 521, 522; 525/301.5, 376, 378, 386, 426, 437, 445; 340/135.1

[56] References Cited

U.S. PATENT DOCUMENTS 4,695,528 9/1987 Dabisch et al. ..... 430/152

*Primary Examiner*—Pamela R. Schwartz

*Attorney, Agent, or Firm*—Oblon, Spivak, McClelland, Maier & Neudstadt

[57] ABSTRACT

A reversible thermosensitive recording material is disclosed, which comprises (a) a support, and (b) a reversible thermosensitive recording layer formed thereon, which comprises as the main components a matrix resin, at least one higher monocarboxylic fatty acid having 16 or more carbon atoms, and at least one aliphatic saturated dicarboxylic acid or a derivative thereof, with the ratio by weight of the amount of the higher monocarboxylic fatty acid to the amount of the aliphatic saturated dicarboxylic acid or a derivative thereof being in the range of (95:5) to (20:80).

12 Claims, 1 Drawing Sheet

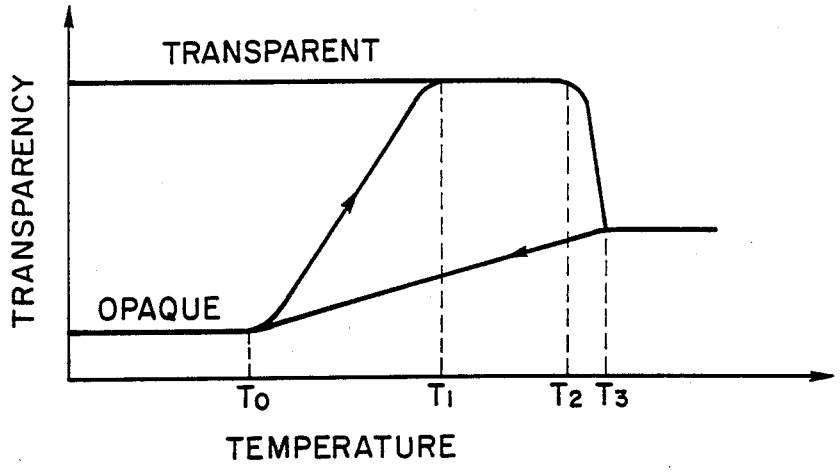
TRANSPARENT
TRANSPARENCY
OPAQUE
To
T1
T2
T3
TEMPERATURE

REVERSIBLE THERMOSENSITIVE RECORDING MATERIAL

BACKGROUND OF THE INVENTION

The present invention relates to a reversible thermosensitive recording material capable of recording images and erasing the same reversibly by utilizing its property that the transparency can be changed reversibly from a transparent state to an opaque state, and vice versa, depending upon the temperature thereof.

Conventionally there are proposed reversible thermosensitive recording materials capable of performing such reversible recording and deleting images, which comprise a support and a reversible thermosensitive recording layer in which an organic low-molecular-weight material, such as a higher alcohol and a high fatty acid, is dispersed in a resin such as polyester and polyamide, as disclosed, for example, in Japanese Laid-Open Patent Application Nos. 54-119377 and 55-154198. In these reversible thermosensitive recording materials, the property that the transparency of the recording layer changes in accordance with the temperature thereof is utilized for forming images and erasing the same in the recording layer.

Such conventional reversible thermosensitive recording materials, however, have the shortcoming that the range of the transparent state in terms of the temperature is as narrow as 2° to 4° C. Therefore it is difficult to control the temperature at which a partially opaque reversible thermosensitive recording material is totally changed to an transparent state, or a totally opaque reversible thermosensitive recording material is made partially transparent to form transparent images thereof. Furthermore, the conventional reversible thermosensitive recording materials have the shortcoming that the temperature at which the recording materials reversibly change from a transparent state to an opaque state or vice versa is 70° C. or less, so that the transparent state, when preserved, becomes partially or entirely opaque with time.

SUMMARY OF THE INVENTION

It is therefore an object of the present invention to provide a reversible thermosensitive recording material capable of forming clear images with high contrast, which is particularly improved in that the control of the temperature for reversibly forming a transparent state or an opaque state is easy and the preservability of the transparent state is significantly prolonged so that the transparent state can be maintained for an extended period of time.

Another object of the present invention is to provide a reversible thermosensitive recording material having high and stable image formation and erasing performance even when used in repetition over an extended period of time.

The above object of the present invention can be achieved by a reversible thermosensitive recording material comprising (a) a support, and (b) a reversible thermosensitive recording layer formed thereon, which comprises as the main components a matrix resin, at least one higher monocarboxylic fatty acid having 16 or more carbon atoms, and at least one aliphatic saturated dicarboxylic acid or a derivative thereof, with the ratio by weight of the amount of the higher monocarboxylic fatty acid to the amount of the aliphatic saturated dicarboxylic acid or a derivative thereof being preferably in the range of (95:5) to (20:80).

BRIEF DESCRIPTION OF THE DRAWINGS

In the drawing, the single FIGURE is a diagram in explanation of the principle of the formation and erasion of images in a reversible thermosensitive recording material according to the present invention.

DETAILED DESCRIPTION OF THE PREFERRED EMBODIMENTS

A transparent state and a milky white opaque state of the reversible thermosensitive recording material according to the present invention are considered to be caused by the difference in the size of the crystals of the higher monocarboxylic fatty acid and aliphatic saturated dicarboxylic acid or a derivative thereof (which are collectively referred to as the organic low-molecular-weight components), which are dispersed in the form of particles in a matrix resin. In the transparent state, the organic low molecular weight components consist of relatively large crystals, possibly most of them being single crystals, so that the light which enters the crystals from one side passes therethrough to the opposite side, without being scattered, thus the reversible thermosensitive material appears transparent. In the milky white opaque state, the organic low-molecular-weight components are composed of polycrystals consisting of numerous small crystals with the crystallographic axes directed in different directions, so that the light which enters the recording layer is scattered a number of times. As a result, the recording layer becomes opaque in a milky white color.

The principle of the formation and erasion of images in the reversible thermosensitive recording material will now be explained with reference to the single FIGURE.

In the figure, it is supposed that the thermosensitive recording layer is initially in a milky white opaque state at room temperature $T_0$ or below and this opaque state will be referred to as a maximum opaque state. When the recording material is heated to a temperature $T_1$, the recording layer becomes transparent. This transparent state is maintained even if the temperature is further heated to a temperature $T_2$. Thus, the recording material reaches a maximum transparent state at temperature $T_1$, and is in the maximum transparent state at temperatures $T_1$ through $T_2$. Even if the recording material which is already in the maximum transparent state is cooled to the room temperature $T_0$ or below, the same maximum transparent state is maintained. It is considered that this is because the organic low-molecular-weight components change their state from a polycrystalline state to a single crystalline state via a semi-melted state during the above-mentioned heating and cooling steps.

When the recording material in the maximum transparent state is further heated to temperature $T_3$, it reaches a medium state which is between the maximum transparent state and the milky white opaque state. When the recording medium in the medium state at temperature $T_3$ is cooled to the room temperature $T_0$ or below, the recording material returns to the original maximum opaque state, without passing through any transparent state. It is considered that this is because the organic low-molecular-weight components are melted when heated to temperature $T_3$ or above, and the polycrystals of the organic low-molecular-weight components grow when cooled to temperature $T_0$ or below. If the recording material in the milky white opaque state is heated to any temperature between temperature $T_0$ and temperature $T_{T1}$ and then cooled to a temperature below $T_0$, the recording material reaches an intermediate state between the transparent state and the milky white opaque state.

When the recording material in the transparent state at room temperature $T_0$ is again heated to temperature $T_3$ or above, and then cooled to room temperature $T_0$, the recording material returns to the maximum milky white opaque state. Thus, the reversible thermosensitive recording material according to the present invention can be in a milky white maximum opaque state, a maximum transparent state, and an intermediate state between the aforementioned two states at room temperature.

Therefore, for example, when a thermosensitive recording material comprising a support and such a reversible thermosensitive recording layer formed thereon is heated to any temperature between $T_1$ and $T_2$ to reach a transparent state and then cooled to room temperature, while maintaining the same transparent state, and then the recording material is partially or imagewise heated to a temperature above $T_3$ by use of a heat application means such as a thermal head and then cooled to room temperature to make the heat-applied portions milky white opaque, white images can be formed on the recording material at room temperature. When a colored sheet or board, for instance, a black paper, is placed behind the white image bearing reversible thermosensitive recording material in contact therewith, milky white images on a colored (for instance, black) background can be obtained. When this white image bearing reversible thermosensitive recording material is employed as an original in an overhead projector, the milky white images are projected on a screen with the dark images corresponding to the white images with the light background corresponding to the transparent background of the recording material. Furthermore, when the reversible thermosensitive recording material is heated to a temperature above $T_3$ and then cooled to room temperature $T_0$ or below to reach a milky white opaque state, and then the recording material is partially or imagewise heated to a temperature between $T_1$ and $T_2$ by use of a thermal heat to make the heat-applied portions transparent, transparent images can be formed on the milky white background at room temperature.

The reversible thermosensitive recording material according to the present invention can be prepared by forming a reversible thermosensitive recording layer on a support.

For the preparation of the reversible thermosensitive recording layer, the following solution or dispersion is first prepared: (1) a solution of a resin, a higher monocarboxylic fatty acid having 16 or more carbon atoms, and an aliphatic saturated dicarboxylic acid or a derivative thereof dissolved in a solvent; or (2) a dispersion of a higher monocarboxylic fatty acid having 16 or more carbon atoms, and an aliphatic saturated dicarboxylic acid or a derivative thereof, which are dispersed in a solution of a resin serving as a matrix resin dissolved in a solvent, which solvent does not dissolve at least one of the higher monocarboxylic fatty acid or the aliphatic saturated dicarboxylic acid or a derivative thereof, and a solvent having high boiling point, such as plasticizers as will be mentioned later.

The above solution or dispersion is applied to a support such as a plastic film, a glass plate, or a metal plate and the applied solution or dispersion is dried, whereby a reversible thermosensitive recording layer is formed on the support.

As the solvent for use in the solution or dispersion for forming the reversible thermosensitive recording layer, a variety of solvents can be employed, depending upon the kind of the organic low-molecular-weight components and the matrix resin employed. Specific examples of the solvent are tetrahydrofuran, methyl ethyl ketone, methyl isobutyl ketone, chloroform, carbon tetrachloride, ethanol, toluene and benzene. Not only in the case where the above-mentioned dispersion (2) is employed, but also in the case where the solution (1) is employed, the organic low-molecular-weight components are present in the form of small crystals dispersed in the reversible thermosensitive recording layer.

As the matrix resin for use in the reversible thermosensitive recording layer, such resins are preferably employed that can hold the organic low-molecular-weight components in a uniformly dispersed state in the recording layer and impart the maximum transparency to the recording layer when the recording layer is in a maximum transparent state, and are mechanically stable and have excellent film-forming properties.

Specific examples of the matrix resin for use in the reversible thermosensitive recording layer are polyvinyl chloride; vinyl chloride copolymers such as vinyl chloride-vinyl acetate copolymer, vinyl chloride-vinyl acetate-vinyl alcohol copolymer, vinyl chloride-vinyl acetate-maleic acid copolymer, and vinyl chloride-acrylate copolymer; polyvinylidene chloride; vinylidene chloride copolymers such as vinylidene chloride-vinyl chloride copolymer and vinylidene chloride-acrylonitrile copolymer; polyester; polyamide; polyacrylate, polymethacrylate, acrylate-methacrylate copolymer, and silicone resin. These resins may be used alone or in combination.

The organic low-molecular-weight components for use in the present invention are appropriately selected in accordance with each of the desired temperature ranges, $T_0$ to $T_1$, $T_1$ to $T_2$, and $T_2$ to $T_3$.

As one of the organic low-molecular-weight components, a higher monocarboxylic fatty acid having 16 or more carbon atoms is employed.

Examples of the higher monocarboxylic fatty acid are (1) a saturated higher fatty acid having 16 or more carbon atoms, preferably a saturated higher fatty acid having 16 to 26 carbon atoms, or a saturated higher fatty acid having a melting point of about 30° C. to about 150° C., and (2) an unsaturated fatty acid.

Specific examples of the saturated higher fatty acid having are palmitic acid, margaric acid, stearic acid, nonadecanoic acid, eicosanic acid, heneicosanic acid, behenic acid, lignoceric acid, pentacosanoic acid, cerotic acid, heptacosanoic acid, montanic acid, nonacosanoic acid, and melissic acid. Of these saturated higher fatty acids, stearic acid, eicosanic acid and behenic acid are more preferable for use in the present invention.

Specific example of the unsaturated fatty acids are 2-hexadecenoic acid, trans-3-hexadecenoic acid, 2-heptadecenoic acid, trans-2-octadecenoic acid, cis-2-octadecanoic acid, trans-4-octadecenoic acid, cis-6-octadecenoic acid, eleidic acid, trans-11-octadecenoic acid, trans-11-eicosenoic acid, erucic acid, brassidic acid, selacholeic acid, trans-selacholeic acid, trans-8, trans-10-octadecadienoic acid, linoelaidic acid, α-eleostearic acid, β-eleostearic acid, pseudoeleostearic acid, and 12,20-heneicosadienoic acid.

The above-mentioned fatty acids may be employed alone or in combination.

As the other organic low-molecular-weight component, for example, the following aliphatic saturated dicarboxylic acids and derivatives thereof, having a melting point in the range of 80° C. to 200° C., may be preferably employed in the present invention.

| | | Melting point (°C.) |
|---|---|---|
| succinic acid | $(CH_2)_2(COOH)_2$ | 185 |
| glutaric acid | $(CH_2)_3(COOH)_2$ | 98~99 |
| adipic acid | $(CH_2)_4(COOH)_2$ | 153.1 |
| pimelic acid | $(CH_2)_5(COOH)_2$ | 105~105.5 |
| suberic acid | $(CH_2)_6(COOH)_2$ | 140 |
| azelaic acid | $(CH_2)_7(COOH)_2$ | 107 |
| sebacic acid | $(CH_2)_8(COOH)_2$ | 133~133.5 |
| undecanedioic acid | $(CH_2)_9(COOH)_2$ | 111 |
| dodecanedioic acid | $(CH_2)_{10}(COOH)_2$ | 128 |
| tridecanedioic acid | $(CH_2)_{11}(COOH)_2$ | 113.2 |
| tetradecanedioic acid | $(CH_2)_{12}(COOH)_2$ | 125 |
| pentadecanedioic acid | $(CH_2)_{13}(COOH)_2$ | 114.8 |
| hexadecanedioic acid | $(CH_2)_{14}(COOH)_2$ | 125.2 |
| heptadecanedioic acid | $(CH_2)_{15}(COOH)_2$ | 118 |
| octadecanedioic acid | $(CH_2)_{16}(COOH)_2$ | 124.8 |
| nonadecanedioic acid | $(CH_2)_{17}(COOH)_2$ | 119.2 |
| malonic acid p-nitrobenzyl ester | | 86 |
| malonic acid S-p-bromobenzylthiuronium salt | | 139 |
| malonic acid benzylammonium salt | | 143 |
| malonic acid diamide | | 170 |
| malonic acid anilide | | 132 |
| succinic acid p-nitrobenzyl ester | | 88 |
| succinic acid phenacyl ester | | 148 |
| succinic acid S-p-chlorobenzylthiuronium salt | | 167 |
| succinic acid benzylammonium salt | | 148 |
| succinic acid monoamide | | 113 |
| succinic acid anilide | | 145 |
| succinic acid dihydrazide | | 167 |
| glutaric acid phenacyl ester | | 105 |
| glutaric acid p-bromophenacyl ester | | 137 |
| glutaric acid S-p-bromobezylthiuronium salt | | 149 |
| glutaric acid anilide | | 126 |
| adipic acid p-nitrobenzyl ester | | 106 |
| adipic acid phenacyl ester | | 88 |
| adipic acid monoamide | | 125 |
| adipic acid anilide | | 152 |
| pimelic acid p-bromophenacyl ester | | 137 |
| pimelic acid anilide | | 113 |
| pimelic acid dianilide | | 155 |
| pimelic acid dibenzalhydrazide | | 185 |
| suberic acid p-nitrobenzyl ester | | 85 |
| suberic acid phenacyl ester | | 102 |
| suberic acid monoamide | | 125 |
| suberic acid anilide | | 128 |
| azelaic acid p-bromophenancyl ester | | 131 |
| azelaic acid p-phenylphenancyl ester | | 141 |
| azelaic acid monoamide | | 93 |
| sebacic acid phenacyl ester | | 80 |
| sebacic acid p-phenylphenancyl ester | | 140 |
| sebacic acid benzylammonium salt | | 122 |

Of the above aliphatic saturated dicarboxylic acids, suberic acid, azelaic acid, sebacic acid, undecanedioic acid, dodecanedioic acid, tridecanedioic acid, tetradecanedioic acid, and pentadecanedioic acid are particularly preferable for use in the present invention.

In the present invention, it is preferable that the above-mentioned monocarboxylic fatty acids and aliphatic saturated dicarboxylic acid or a derivative thereof be selectively employed in such a combination that the melting point of the employed dicarboxylic acid or a derivative thereof is higher than that of the employed monocarboxylic fatty acid. Further, it is preferable that the ratio by weight of the monocarboxylic fatty acid to the aliphatic saturated dicarboxylic acid or a derivative thereof be (95:5) to (20:80).

Furthermore, in the present invention, it is preferable that the ratio by weight of the amount of the organic low-molecular-weight components of the higher monocarboxylic fatty acid and the aliphatic saturated dicarboxylic acid to the previously mentioned matrix resin be in the range of (1:0.5) to (1:16), more preferably in the range of (1:1) to (1:3) for the formation of a stable reversible thermosensitive recording layer capable of attaining a maximum transparency.

It is preferable that the thickness of the thermosensitive recording layer be in the range of 1 μm to 30 μm for obtaining suitable thermosensitivity and images with high contrast.

In order to maintain the temperature range in which the maximum transparent state is maintained even when the reversible thermosensitive recording material is used in repetition over an extended period of time, it is preferable to add surface active agents in general use to the reversible thermosensitive recording layer.

Preferable examples of such surface active agents for use in the present invention are fatty esters, such as polyhydric alcohol-higher fatty acid ester, polyhydric alcohol-higher alkyl ether; lower olefin oxide adducts of polyhydric alcohol-higher fatty acid ester, higher alcohol, higher alkylphenol, higher fatty acid-higher alkylamine, higher fatty acid amide, fats, oils, and polypropyrene glycol; acetylene glycol; sodium, calcium, barium and magnesium salts of higher alkylbenzenesulfonic acid; calcium, barium and magnesium salts of aromatic carboxylic acid, higher aliphatic sulfonic acid, aromatic sulfonic acid, sulfuric acid monoester, phosphoric mono-589 di-esters; low-degree sulfonated oil; poly long-chain-alkyl acrylate; acrylic oligomer; poly long-chain-alkyl methacrylate; long-chain-alkyl methacrylate-amine-contained monomer copolymer; styrene-maleic anhydride copolymer; and olefine-maleic anhydride copolymer.

In order to maximize the temperature range in which the maximum transparent state is maintained, it is preferable to add plasticizers for general use in films to the reversible thermosensitive recording layer.

Preferable examples of such plasticizers are tributyl phosphate, tri-2-ethylhexyl phosphate, triphenyl phosphate, tricresyl phosphate, butyl oleate, dimethyl phthalate, diethyl phthalate, dibutyl phthalate, diheptyl phthalate, di-n-octyl phthalate, di-2-ethylhexyl phthalate, diisononyl phthalate, dioctyldecyl phthalate, diisodecyl phthalate, butylbenzyl phthalate, dibutyl adipate, di-n-hexyl adipate, di-2-ethylhexyl adipate, di-2-ethylhexyl azelate, dibutyl cebacate, di-2-ethylhexyl cebacate, ethylene glycol dibenzoate, triethylene glycol-2-ethyl butylate, methyl acetylricinoleate, butyl acetylricinoleate, butylphthalyl butylglycolate, and tributyl acetylcitrate.

In the present invention, it is preferable that the ratio by weight of the mount of the organic low-molecular-weight components to the amount of any of the above surface active agents and plasticizers be approximately in the range of (1:0.01) to (1:0.8).

The present invention will now be explained in more detail with reference to the following examples. These examples are given for illustration of the invention and are not intended to be limiting thereof.

EXAMPLE 1

A mixture of the following components was dispersed, so that a thermosensitive recording layer coating liquid was prepared.

| | Parts by weight |
|---|---|
| Behenic acid | 95 |
| $(CH_2)_{13}(COOH)_2$ | 5 |
| Vinylchloride-vinylacetate copolymer (Trademark "VYHH" made by Union Carbide Corp.) | 250 |
| Di(2-ethylhexyl) phthalate | 30 |
| Tetrahydrofuran | 1500 |

The above prepared thermosensitive recording layer coating liquid was coated on a 100 μm thick polyester film by a wire bar and dried with application of heat thereto, so that a reversible thermosensitive recording layer having a thickness of 15 μm was formed on the polyester film, whereby a reversible thermosensitive recording material No. 1 according to the present invention was prepared.

EXAMPLE 2

A mixture of the following components was dispersed, so that a thermosensitive recording layer coating liquid was prepared.

| | Parts by weight |
|---|---|
| Behenic acid | 80 |
| $(CH_2)_{13}(COOH)_2$ | 20 |
| Vinylchloride-vinylacetate copolymer (Trademark "VYHH" made by Union Carbide Corp.) | 250 |
| Di(2-ethylhexyl) phthalate | 30 |
| Tetrahydrofuran | 1500 |

The above prepared thermosensitive recording layer coating liquid was coated on a 100 μm thick polyester film by a wire bar and dried with application of heat thereto, so that a reversible thermosensitive recording layer having a thickness of 15 μm was formed on the polyester film, whereby a reversible thermosensitive recording material No. 2 according to the present invention was prepared.

EXAMPLE 3

A mixture of the following components was dispersed, so that a thermosensitive recording layer coating liquid was prepared.

| | Parts by weight |
|---|---|
| Behenic acid | 30 |
| $(CH_2)_{13}(COOH)_2$ | 70 |
| Vinylchloride-vinylacetate copolymer (Trademark "VYHH" made by Union Carbide Corp.) | 250 |
| Di(2-ethylhexyl) phthalate | 30 |
| Tetrahydrofuran | 1500 |

The above prepared thermosensitive recording layer coating liquid was coated on a 100 μm thick polyester film by a wire bar and dried with application of heat thereto, so that a reversible thermosensitive recording layer having a thickness of 15 μm was formed on the polyester film, whereby a reversible thermosensitive recording material No. 3 according to the present invention was prepared.

EXAMPLE 4

A mixture of the following components was dispersed, so that a thermosensitive recording layer coating liquid was prepared.

| | Parts by weight |
|---|---|
| Behenic acid | 80 |
| Succinic acid | 20 |
| Vinylchloride-vinylacetate copolymer (Trademark "VYHH" made by Union Carbide Corp.) | 250 |
| Di(2-ethylhexyl) phthalate | 30 |
| Tetrahydrofuran | 1500 |

The above prepared thermosensitive recording layer coating liquid was coated on a 100 μm thick polyester film by a wire bar and dried with application of heat thereto, so that a reversible thermosensitive recording layer having a thickness of 15 μm was formed on the polyester film, whereby a reversible thermosensitive recording material No. 4 according to the present invention was prepared.

EXAMPLE 5

A mixture of the following components was dispersed, so that a thermosensitive recording layer coating liquid was prepared.

| | Parts by weight |
|---|---|
| Behenic acid | 80 |
| Azelaic acid | 20 |
| Vinylchloride-vinylacetate copolymer (Trademark "VYHH" made by Union Carbide Corp.) | 250 |
| Di(2-ethylhexyl) phthalate | 30 |
| Tetrahydrofuran | 1500 |

The above prepared thermosensitive recording layer coating liquid was coated on a 100 μm thick polyester film by a wire bar and dried with application of heat thereto, so that a reversible thermosensitive recording layer having a thickness of 15 μm was formed on the polyester film, whereby a reversible thermosensitive recording material No. 5 according to the present invention was prepared.

EXAMPLE 6

A mixture of the following components was dispersed, so that a thermosensitive recording layer coating liquid was prepared.

| | Parts by weight |
|---|---|
| Behenic acid | 80 |
| $(CH_2)_{10}(COOH)_2$ | 20 |
| Vinylchloride-vinylacetate copolymer (Trademark "VYHH" made by Union Carbide Corp.) | 250 |
| Di(2-ethylhexyl) phthalate | 30 |
| Tetrahydrofuran | 1500 |

The above prepared thermosensitive recording layer coating liquid was coated on a 100 μm thick polyester film by a wire bar and dried with application of heat thereto, so that a reversible thermosensitive recording layer having a thickness of 15 μm was formed on the polyester film, whereby a reversible thermosensitive recording material No. 6 according to the present invention was prepared.

EXAMPLE 7

A mixture of the following components was dispersed, so that a thermosensitive recording layer coating liquid was prepared.

| | Parts by weight |
|---|---|
| Behenic acid | 80 |
| $(CH_2)_{16}(COOH)_2$ | 20 |
| Vinylchloride-vinylacetate copolymer (Trademark "VYHH" made by Union Carbide Corp.) | 250 |
| Di(2-ethylhexyl) phthalate | 30 |
| Tetrahydrofuran | 1500 |

The above prepared thermosensitive recording layer coating liquid was coated on a 100 μm thick polyester film by a wire bar and dried with application of heat thereto, so that a reversible thermosensitive recording layer having a thickness of 15 μm was formed on the polyester film, whereby a reversible thermosensitive recording material No. 7 according to the present invention was prepared.

COMPARATIVE EXAMPLE 1

A mixture of the following components was dispersed, so that a thermosensitive recording layer coating liquid was prepared.

| | Parts by weight |
|---|---|
| Behenic acid | 98 |
| $(CH_2)_{13}(COOH)_2$ | 2 |
| Vinylchloride-vinylacetate copolymer (Trademark "VYHH" made by Union Carbide Corp.) | 250 |
| Di(2-ethylhexyl) phthalate | 30 |
| Tetrahydrofuran | 1500 |

The above prepared thermosensitive recording layer coating liquid was coated on a 100 μm thick polyester film by a wire bar and dried with application of heat thereto, so that a reversible thermosensitive recording layer having a thickness of 15 μm was formed on the polyester film, whereby a comparative reversible thermosensitive recording material No. 1 was prepared.

COMPARATIVE EXAMPLE 2

A mixture of the following components was dispersed, so that a thermosensitive recording layer coating liquid was prepared.

| | Parts by weight |
|---|---|
| Behenic acid | 10 |
| $(CH_2)_{13}(COOH)_2$ | 90 |
| Vinylchloride-vinylacetate copolymer (Trademark "VYHH" made by Union Carbide Corp.) | 250 |
| Di(2-ethylhexyl) phthalate | 30 |
| Tetrahydrofuran | 1500 |

The above prepared thermosensitive recording layer coating liquid was coated on a 100 μm thick polyester film by a wire bar and dried with application of heat thereto, so that a reversible thermosensitive recording layer having a thickness of 15 μm was formed on the polyester film, whereby a comparative reversible thermosensitive recording material No. 2 was prepared.

COMPARATIVE EXAMPLE 3

A mixture of the following components was dispersed, so that a thermosensitive recording layer coating liquid was prepared.

| | Parts by weight |
|---|---|
| Behenic acid | 100 |
| Vinylchloride-vinylacetate copolymer (Trademark "VYHH" made by Union Carbide Corp.) | 250 |
| Di(2-ethylhexyl) phthalate | 30 |
| Tetrahydrofuran | 1500 |

The above prepared thermosensitive recording layer coating liquid was coated on a 100 μm thick polyester film by a wire bar and dried with application of heat thereto, so that a reversible thermosensitive recording layer having a thickness of 15 μm was formed on the polyester film, whereby a comparative reversible thermosensitive recording material No. 3 was prepared.

The thus obtained reversible thermosensitive recording materials No. 1 to No. 7 according to the present invention and comparative reversible thermosensitive recording materials No. 1 to No. 3 were milky white opaque.

Each of the recording materials was heated from 65° C. to 120° C. stepwise with a temperature interval of 1° C. Thus, with respect to each recording material, 56 samples were made at each stepwise-elevated temperature from 65° C. to 120° C. Each sample was placed on a sheet of black paper, and the reflection density of each sample was measured by use of a Macbeth densitometer.

In the above measurement, the temperatures at which the measured reflection density of each sample exceeded 1.0 were recorded, and such temperature points are referred to transparency temperature. The transparency temperature range of each sample was measured by counting the number of above-mentioned temperature points. By use of the thus defined transparency temperature and transparency temperature range, each recording material was evaluated. The results are shown in the following table.

| | Transparency Temperature | Transparency Temperature Range |
|---|---|---|
| Example 1 | 72° C.~78° C. | 7 |
| Example 2 | 73° C.~87° C. | 15 |
| Example 3 | 79° C.~91° C. | 13 |
| Example 4 | 72° C.~83° C. | 12 |
| Example 5 | 67° C.~77° C. | 11 |
| Example 6 | 73° C.~94° C. | 22 |
| Example 7 | 71° C.~85° C. | 15 |
| Comparative Example 1 | 74° C.~77° C. | 4 |
| Comparative Example 2 | 85° C.-88° C. | 4 |
| Comparative Example 3 | 72° C.-74° C. | 3 |

What is claimed is:

1. A reversible thermosensitive recording material comprising:

(a) a support, and (b) a reversible thermosensitive recording layer formed thereon, which comprises as the main components a matrix resin, at least one higher monocarboxylic fatty acid having 16 or more carbon atoms, and at least one aliphatic saturated dicarboxylic acid or derivative thereof, wherein said derivative is selected from the group consisting of p-nitrobenzyl esters, S-p-bromobenzylthiuronium salts, benzylammonium salts, diamides, anilides, phenacyl esters, monoamides, dihydrazides, p-bromophenacyl esters, dianilides, dibenzalhydrazides, S-p-chlorobenzylthiuronium salts, and p-phenylphenacyl esters, with the ratio by weight of the amount of said higher monocarboxylic fatty acid to the amount of said aliphatic saturated dicarboxylic acid or derivative thereof being in the range of (95:5) to (20:80), wherein said higher monocarboxylic fatty acid and said aliphatic saturated dicarboxylic acid or derivative thereof are dispersed as particles in said matrix resin and wherein said higher monocarboxylic fatty acid has a melting point ranging from about 30° C. to about 150° C., and said aliphatic saturated dicarboxylic acid or derivative thereof has a melting point ranging from about 80° C. to about 200° C., with the melting point of said higher monocarboxylic acid being higher than the melting point of said aliphatic saturated dicarboxylic acid or derivative thereof.

2. The reversible thermosensitive recording material as claimed in claim 1, wherein said higher monocarboxylic fatty acid is a saturated higher fatty acid having 16 to 26 carbon atoms.

3. The reversible thermosensitive recording material as claimed in claim 2, wherein said saturated higher fatty acid is selected from the group consisting of palmitic acid, margaric acid, stearic acid, nonadecanoic acid, eicosanic acid, heneicosanic acid, behenic acid, lignoceric acid, pentacosanoic acid, cerotoic acid, heptacosanoic acid, montanic acid, nonacosanoic acid, and melissic acid.

4. The reversible thermosensitive recording material as claimed in claim 3, wherein said saturated higher fatty acid is selected from the group consisting of stearic acid, eicosanic acid and behenic acid.

5. The reversible thermosensitive recording material as claimed in claim 1, wherein the ratio by weight of the amount of said higher monocarboxylic fatty acid and said aliphatic saturated dicarboxylic acid or derivative thereof to the amount of said matrix resin is in the range of (1:0.5) to (1:16).

6. The reversible thermosensitive recording material as claimed in claim 5, wherein the ratio by weight of the amount of said higher monocarboxylic fatty acid and said aliphatic saturated dicarboxylic acid or derivative thereof to the amount of said matrix resin is in the range of (1:1) to (1:3).

7. The reversible thermosensitive recording material as claimed in claim 1, wherein said reversible thermosensitive recording layer further comprises at least one additive selected from the group consisting of a surface active agent and a plasticizer, in such an amount that the ratio by weight of the amount of said higher monocarboxylic fatty acid and said aliphatic saturated dicarboxylic acid or derivative thereof to the amount of said additive is approximately in the range of (1:0.01) to (1:0.8).

8. The reversible thermosensitive recording material as claimed in claim 1, wherein said reversible thermosensitive recording layer has a thickness in the range of 1 μm to 30 μm.

9. The reversible thermosensitive recording material as claimed in claim 1, wherein said matrix resin is selected from the group consisting of polyvinyl chloride, vinyl chloride-vinyl acetate copolymer, vinyl chloride-vinyl acetate-vinyl alcohol copolymer, vinyl chloride-vinyl acetate-maleic acid copolymer, vinyl chloride-acrylate copolymer, polyvinylidene chloride, vinylidene chloride-vinyl chloride copolymer, vinylidene chloride-acrylonitrile copolymer, polyester, polyamide, polyacrylate, polymethacrylate, acrylate-methacrylate copolymer, and silicone resin.

10. The reversible thermosensitive recording material as claimed in claim 1, wherein said higher monocarboxylic fatty acid is a saturated higher fatty acid selected from the group consisting of 2-hexadecenoic acid, trans-3-hexadecenoic acid, 2-heptadecenoic acid, trans-2-octadecenoic acid, cis-2-octadecenoic acid, trans-4-octadecenoic acid, cis-6-octadecenoic acid, elaidic acid, trans-11-octadecenoic acid, trans-11-eicosenoic acid, erucic acid, brassidic acid, selacholeic acid, trans-selacholeic acid, trans-8-trans-10-octadecadienoic acid, linoelaidic acid, α-eleostearic acid, β-eleostearic acid, pseudoeleostearic acid, and 12,20-heneicosadienoic acid.

11. The reversible thermosensitive recording material as claimed in claim 1, wherein said aliphatic saturated dicarboxylic acid is selected from the group consisting of: succinic acid, glutaric acid, adipic acid, pimelic acid, suberic acid, azelaic acid, sebacic acid, undecanedioic acid, dodecanedioic acid, tridecanedioic acid, tetradecanedioic acid, pentadecanedioic acid, hexadecanedioic acid, heptadecanedioic acid, octadecanedioic acid, and nonadecanedioic acid.

12. The reversible thermosensitive recording material as claimed in claim 11, wherein said aliphatic saturated dicarboxylic acid is selected from the group consisting of: suberic acid, azelaic acid, sebacic acid, undecanedioic acid, dodecanedioic acid, tridecanedioic acid, tetradecanedioic acid, and pentadecanedioic acid.

* * * * *

UNITED STATES PATENT AND TRADEMARK OFFICE

CERTIFICATE OF CORRECTION

PATENT NO. : 4,917,948

DATED : April 17, 1990

INVENTOR(S) : Yoshihiko Hotta

It is certified that error appears in the above-identified patent and that said Letters Patent is hereby corrected as shown below:

In column 3, line 4; "$T_{T1}$" should read --$T_1$--.

In column 4, line 54; delete "having".

In column 4, line 61; "example" should read --examples--.

In column 6, line 36; "mono-589" should read --mono- and--.

In column 10, line 41; "to transparency temperature" should read --to as transparency temperatures--.

Signed and Sealed this

Seventeenth Day of March, 1992

*Attest:*

HARRY F. MANBECK, JR.

*Attesting Officer*

*Commissioner of Patents and Trademarks*